US010799013B2

(12) United States Patent
Slovis

(10) Patent No.: US 10,799,013 B2
(45) Date of Patent: Oct. 13, 2020

(54) HANDLE FOR A CONTAINER

(71) Applicant: Adam J. Slovis, Memphis, TN (US)

(72) Inventor: Adam J. Slovis, Memphis, TN (US)

( * ) Notice: Subject to any disclaimer, the term of this patent is extended or adjusted under 35 U.S.C. 154(b) by 212 days.

(21) Appl. No.: 15/788,211

(22) Filed: Oct. 19, 2017

(65) Prior Publication Data

US 2018/0035794 A1 Feb. 8, 2018

Related U.S. Application Data

(62) Division of application No. 14/846,430, filed on Sep. 4, 2015, now Pat. No. 9,826,820.

(51) Int. Cl.

| | |
|---|---|
| ***A45C 13/30*** | (2006.01) |
| ***A45F 5/10*** | (2006.01) |
| ***A45C 13/26*** | (2006.01) |
| ***B65D 25/28*** | (2006.01) |
| *A45C 13/22* | (2006.01) |

(52) U.S. Cl.

CPC ..... *A45F 5/10* (2013.01); *A45C 13/26* (2013.01); *A45C 13/30* (2013.01); *A45F 5/102* (2013.01); *B65D 25/2873* (2013.01); *A45C 2013/223* (2013.01); *A45F 2200/0566* (2013.01)

(58) Field of Classification Search

CPC .... A45F 5/10; A45F 5/102; A45F 2200/0566; B65D 25/2873; A45C 13/26; A45C 13/30; A45C 2013/223

USPC ..... 220/761

See application file for complete search history.

(56) References Cited

U.S. PATENT DOCUMENTS

| | | | | | |
|---|---|---|---|---|---|
| 1,550,904 | A * | 8/1925 | Jones | A44B 11/00 | 24/323 |
| 1,903,798 | A * | 4/1933 | Turner | A01K 97/08 | 224/613 |
| 2,473,977 | A | 6/1949 | Tutton | | |
| 2,645,407 | A * | 7/1953 | Bergstein | B65D 5/46016 | 229/117.24 |
| 2,962,187 | A * | 11/1960 | Morris | A45C 11/00 | 220/780 |
| 3,127,011 | A * | 3/1964 | Weddle | B65D 11/02 | 206/423 |
| 3,811,216 | A * | 5/1974 | Sauey | A01K 97/08 | 43/26 |
| 5,133,290 | A * | 7/1992 | De Marco | A01K 1/0245 | 119/497 |

(Continued)

*Primary Examiner* — King M Chu

(74) *Attorney, Agent, or Firm* — Veritay Group, IP PLLC; Susan B. Fentress

(57) ABSTRACT

This invention in provides an a method to attach a handle to a generally rounded shipping container by attaching each end of a handle to opposite ends of a generally rounded shipping container to form a handle assembly made of a plurality of end cap units, each of the plurality of end cap units having an internal partition with a slit configured to retain a buckle, wherein the buckle is connected to a handle. This invention also provides an assembly made of plurality of retaining tabs each with a slit configured to retain one side of a handle and the handle connected to said plurality of retaining tabs and a plurality caps configured to retain said plurality of retaining tabs to affix a handle to said shipping container. The assembly, in an exemplary embodiment, can include a retaining tab made of a plurality of generally flat first retaining element and generally flat second retaining element.

3 Claims, 4 Drawing Sheets

(56) References Cited

U.S. PATENT DOCUMENTS 5,335,809 A * 8/1994 Toida ..... A47J 41/0011
220/23.88
8,985,330 B1 * 3/2015 Normand ..... B65D 85/72
206/427

* cited by examiner

HANDLE FOR A CONTAINER

CROSS-REFERENCE TO RELATED APPLICATIONS

This application is a divisional patent application of U.S. Ser. No. 14/846,430 filed Sep. 4, 2015 (hereby incorporated by reference in its entirety).

BACKGROUND OF THE INVENTION

Field of the Invention

This disclosure relates to an apparatus for providing a handle to a shipping container and a method to attach a handle to a shipping container.

Description of Related Art Including Information Disclosed Under 37 CFR 1.97 and 1.98.

Packaging, such as box containers, is handled by automated equipment during shipment and is designed to present smooth surfaces, without handles to the automation equipment. This configuration reduces the chance of blockage of the equipment and the concomitant delay to sort out a tangle of packages. Unfortunately, this shipping requirement prevents package manufacturers from building convenient handles on their packaging.

BRIEF SUMMARY OF THE INVENTION

This invention provides an assembly made a plurality of end cap units, each of the plurality of end cap units is sized to retain one end of a shipping container; each of the plurality of end cap units has an internal partition with a slit; wherein the plurality of end cap units are configured to attach to each other and form a cavity to retain a plurality of buckles connected to a handle, when the handle is in a coiled configuration. More specially, this invention provides a generally round shipping container having the plurality of end cap units attached to each end of the round shipping container, wherein the handle projects away from each of the plurality of end cap units, to form a closed loop to carry the container.

This invention, in another embodiment, provides an assembly made of a plurality of retaining tabs, each of the plurality of retaining tabs are made of a first flat retaining element and second flat retaining element. The first retaining element and second retaining element are at a right angle relative to each other, wherein the second retaining element has a slit configured to retain one side of a handle. The assembly further includes a shipping container, wherein the handle is connected to the plurality of retaining tabs and a plurality of caps are configured to retain each of the first flat retaining elements within in the shipping container, to affix the handle to the shipping container.

This invention provides a method to attach a handle to a shipping container. The steps involve attaching each end of a handle to opposite ends of the shipping container to form a handle.

In one embodiment this method includes the steps of: attaching a plurality of end cap units to the opposite ends of a shipping container, each of the plurality of end cap units having an internal partition with a slit configured to retain a buckle, wherein the buckle is connected to a handle.

In one embodiment, this method involves the steps of: providing an apparatus made of a plurality of retaining tabs, each of the plurality of retaining tabs are made of a first flat retaining element and second flat retaining element. The first retaining element and second retaining element are at a right angle relative to each other and the second retaining element has a slit configured to retain one side of a handle; providing a shipping container; positioning the first flat retaining element for each of the plurality of retaining tabs inside of the shipping container; and positioning a cap on each end of the shipping container to retain each of the first flat retaining elements within the shipping container so as to affix the handle to the shipping container.

BRIEF DESCRIPTION OF SEVERAL VIEWS OF THE DRAWING(S)

The invention can be best understood by those having ordinary skill in the art by reference to the following detailed description when considered in conjunction with the accompanying drawings in which.

DETAILED DESCRIPTION OF THE INVENTION

Figure 1:
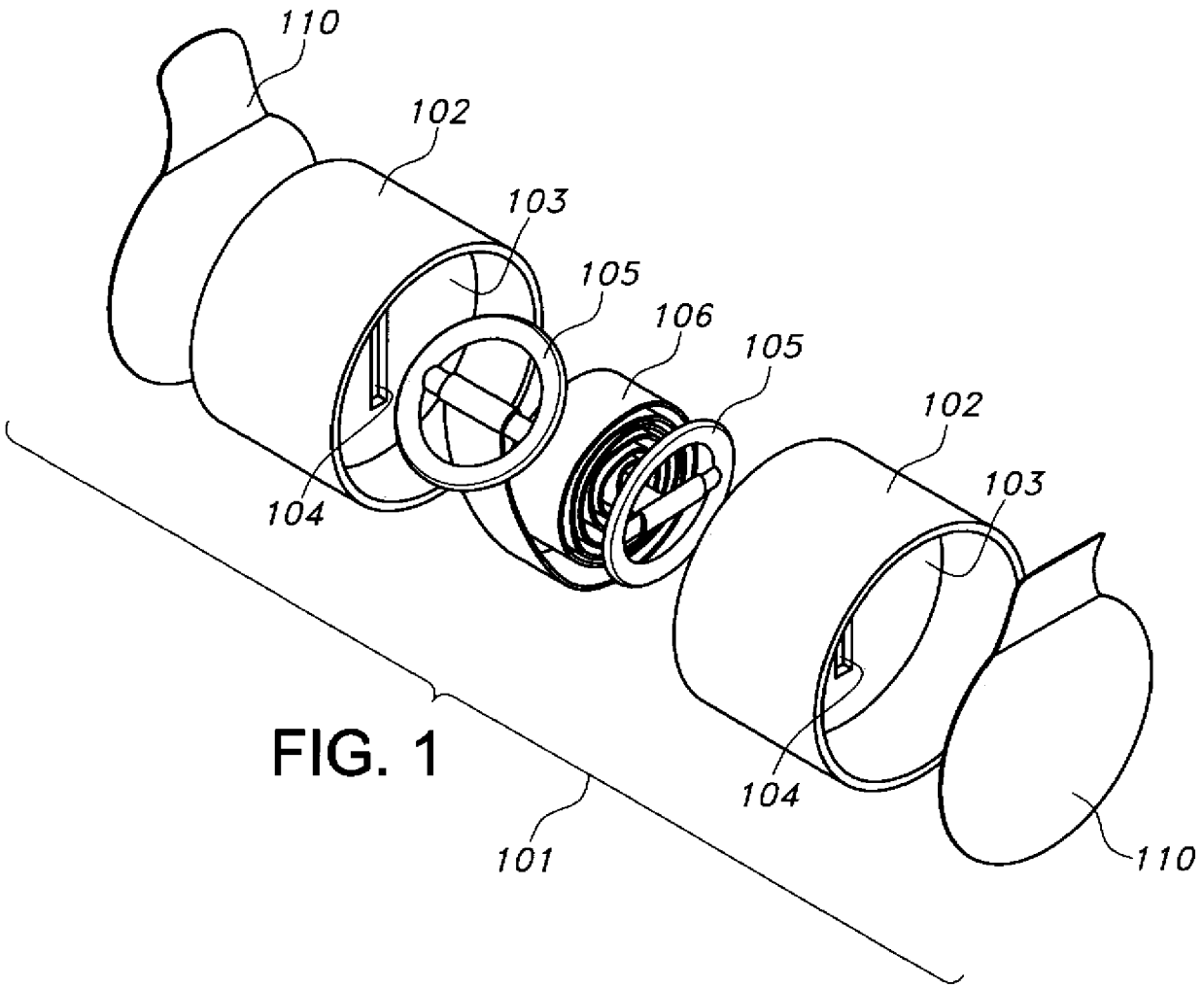
FIG. 1 illustrates an exploded isometric view of an exemplary embodiment of a handle assembly.
Figures 2, 3:
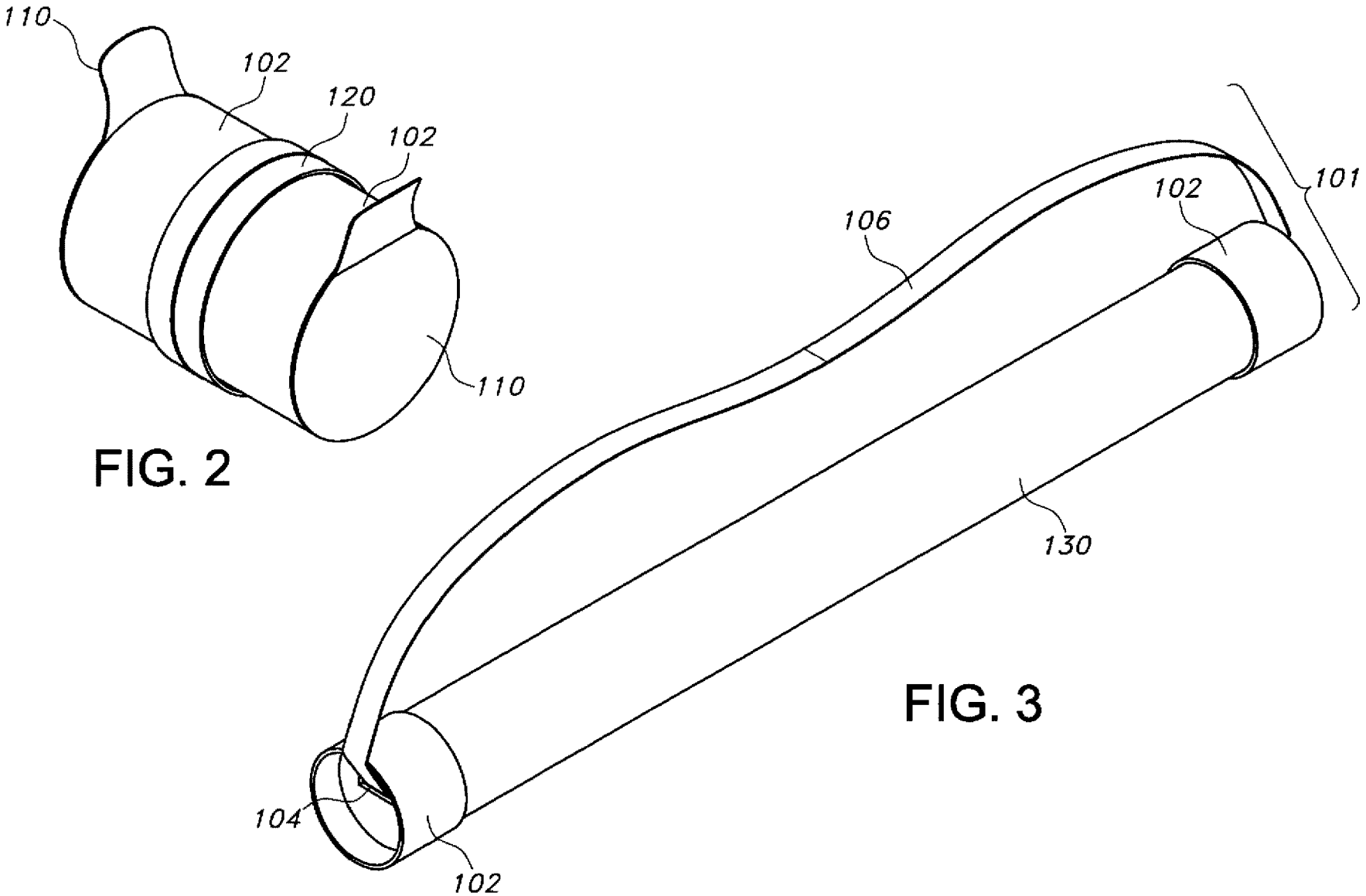
FIG. 2 illustrates a compressed isometric view of an exemplary embodiment of a handle assembly.
FIG. 3 illustrates a compressed isometric view of an exemplary embodiment of a handle assembly with a mailing container.

Now referring to FIGS. 1-2, explode and compressed views of an exemplary embodiment of a handle assembly 101 are shown. The handle assembly 101 includes a plurality of end cap units 102. In this exemplary embodiment, the plurality of end cap units 102 are generally round in shape and are configured to connect to a shipping container by fitting over the outside of the shipping container. For example, if a shipping container is 6 inches in diameter, each inside diameter of the plurality of end cap units 102 are slightly larger than 6 inches to fit snuggly over each end of the shipping container.

Each of the plurality of end cap units 102 have an internal partition 103 with a slit 104 configured to retain buckle 105. A plurality of buckles 105 are connected to a handle 106. A release tab 110 is affixed to an end of each of the plurality of end cap units 102. In usage, the release tab 110 is peeled from each of the plurality of end cap units 102 to reveal the internal partition 103 with a slit 104. Each of the plurality of end cap units 102, when connected to each other form a cavity to retain the plurality of buckles 105 are connected to a handle 106, when the handle 106 is in the coiled configuration.

The compressed handle assembly 101 is sealed by seal 120 projecting around the plurality of end cap units 102 to hold the plurality of end cap units 102 in the compressed form. The seal 120 in one embodiment can be a center tape.

The assembly of this invention, can be made for example from card-stock or cardboard 'F' Flute, or from a plastic, like sheet good polypropylene. The cap end units 102 can be cardboard or plastic and the handle can be cloth or film. The plurality of end cap units 102 have depth in order to engage the container in a structural manner for which the container may be filled with the weight of paper and still remain sound and secure in transport.

Now referring to FIG. 3, the handle assembly 101 is installed on a shipping container 130, such as a generally rounded tube. The plurality of end cap units 102 are generally round in shape and are configured to connect to the ends of shipping container 130. Handle 106 projects from each of the plurality of end cap units 102 and the handle 106 is retained by a plurality of buckles 105, each secured in one of the of slits 104 in the plurality of internal partitions 103.

Now referring to FIG. 4, the method of assembly is shown. In FIG. 4A, the compressed handle assembly 101 is opened by removing seal 120. In FIGS. 4B-D, the release tabs 110 are removed to show a plurality of buckles 105 connected to a handle 106. When the release tabs 110 are removed, the plurality of buckles 105 are not visible yet, until the center tape 120 is removed. Each of the plurality of buckles 105 is turned sidewise to project thought through one of the plurality of slits 104, and then turned to be parallel with the internal partition 103 to securely retain each of the plurality buckles in each of the plurality of slots 104.

Figure 4D:
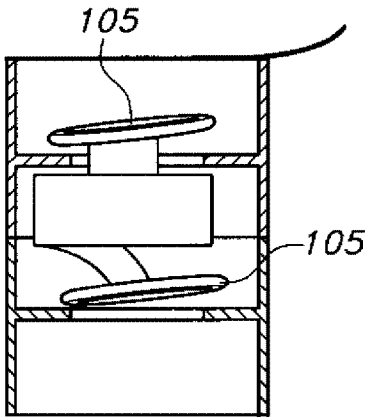
FIGS. 4A-4E illustrate various views of exemplary embodiments of a handle assembly with a mailing container.
Figure 4C:
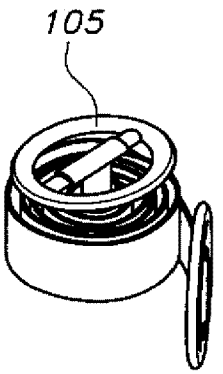
Figure 4E:
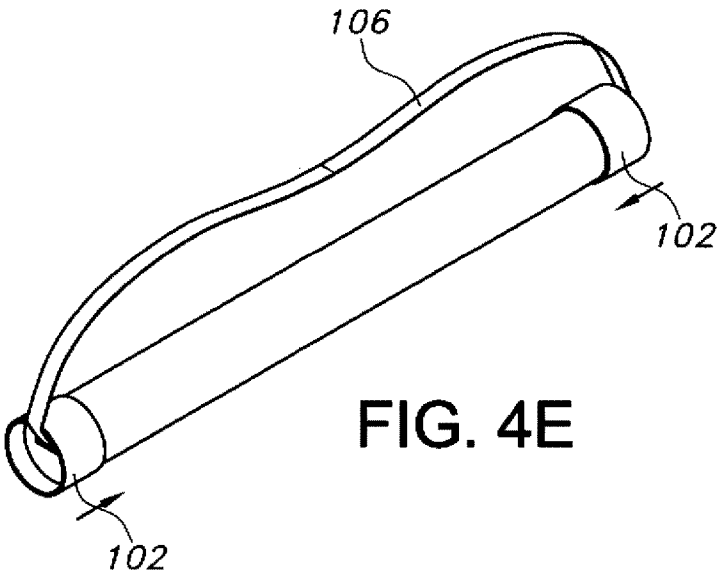
Figure 4B:
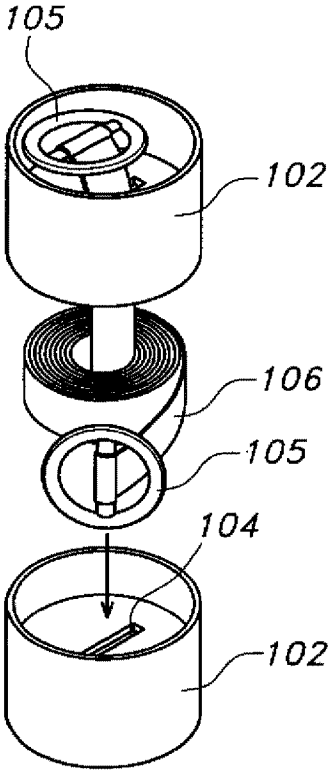
Figure 4A:
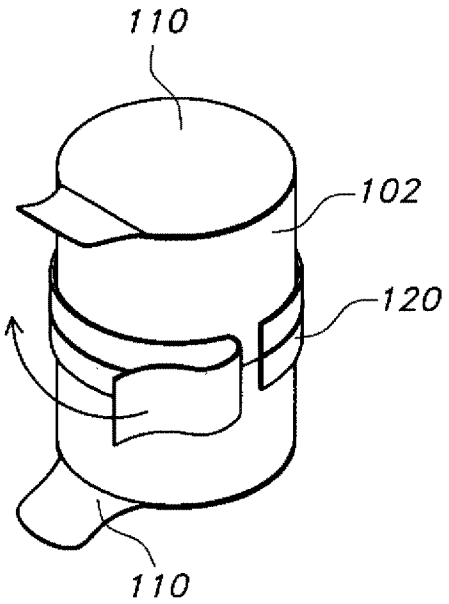

As shown in FIG. 4E, the handle 106 projects away from each of the plurality of end cap units 102, to form a closed loop to carry the container 130, when installed on the mailing container. This closed loop is achieved by connecting each of the plurality of end cap units 102 with the handle 106 projecting away from each of the plurality of end cap units 102, to form a closed loop to carry the container 130.

Figures 5A, 5B, 5C:
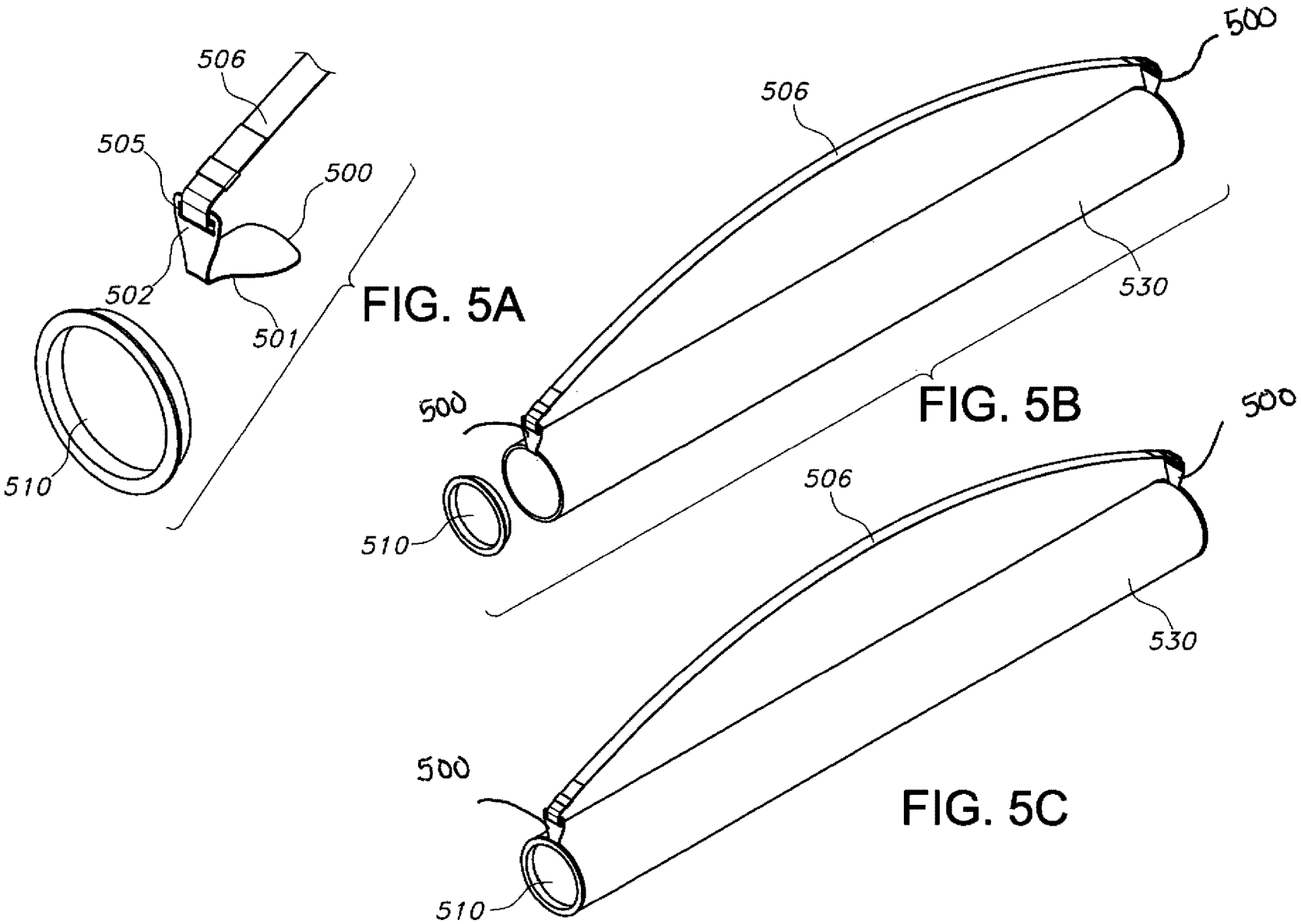
FIGS. 5A-5C illustrate various views of an exemplary embodiment of a handle assembly with a mailing container

Now referring to FIG. 5., an alternative embodiment, is shown. This embodiment provides a plurality of retaining tabs 500 to attach a handle 506. Each of the plurality of retaining tabs 500 are made of a generally flat first retaining element 501 and generally flat second retaining element 502. The first retaining element 501 and second retaining element 502 are generally at a right angle relative to each other. The second retaining element 502 has a slit 505 configured to retain one side of a handle 506.

The opposite side of the handle 506, is retained by a second retaining tab 500 that is made of a generally flat first retaining element 501 and generally flat second retaining element 502. The first retaining element 501 and second retaining element 502 are generally at a right angle relative to each other. The second retaining element 502 has a slit 505 configured to retain one side of a handle 506.

In use, each of the first retaining elements 501 of the plurality of retaining tabs 500 are placed into the container and a cap of a plurality of caps 510 is placed on to the end of the container 530 to secure each of the plurality of retaining tab 500 within the container 530. The shape of the retaining tab 500 can be of any shape designed by one skilled in the art to allow the plurality of caps 510 to retain the retaining tab 500.

The retaining element 500 can be made from die cut card stock, die cut plastic or stamped metal. The flat retaining element can have an adhesive strip (not shown) on one side to adhere it to the inner wall of the container. The handle can be made of paper form, TYVEK, cloth or film; static or elastic.

The present invention may be understood more readily by reference to the following detailed description of the invention. It is to be understood that this invention is not limited to the specific devices, methods, conditions or parameters described herein, and that the terminology used herein is for the purpose of describing particular embodiments by way of example only and is not intended to be limiting of the claimed invention. Also, as used in the specification containing the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value.

I claim:

1. An attachable handle assembly for a hollow tubular shipping container, initially without a handle, said assembly comprising:

a plurality of end cap units, each of said plurality of end cap units configured to attach to an end of a hollow tubular shipping container;

a plurality of retaining tabs, each of the plurality of retaining tabs comprised of a first flat retaining element and a second flat retaining element, the first flat retaining element and second flat retaining element generally at a right angle relative to each other, wherein said second flat retaining element comprises an opening receiving a handle comprised of a strap having a first and second end; wherein each of said plurality of end cap units are configured to retain the first flat retaining element inside the hollow tubular shipping container and the second flat retaining element outside the hollow tubular shipping container when the plurality of end cap units are inserted into the hollow tubular shipping container, and; wherein the first end of the handle is retained by the opening in one of the second flat retaining element of one of the plurality of retaining tabs and wherein the second end of the handle is retained by the opening in the second flat retaining element of another of the one of plurality of retaining tabs to form the handle; the assembly further comprising a hollow tubular shipping container.

2. A method to attach a handle to a hollow shipping container previously without a handle comprising:

providing a plurality of end cap units, each of said plurality of end cap units configured to attach to an end of a hollow shipping container;

providing a plurality of retaining tabs, wherein the plurality of retaining tabs are initially separated from the hollow shipping container, each of the plurality of retaining tabs comprised of a first flat retaining element and a second flat retaining element, the first retaining element and the second retaining element generally at a right angle relative to each other, wherein said second flat retaining element comprises an opening retaining a first or second end of a handle;

positioning the first flat retaining element for each of the plurality of retaining tabs within the hollow shipping container; positioning the second flat retaining element for each of the plurality of retaining tabs outside of the shipping container; connecting each of said plurality of end cap units to the hollow shipping container, wherein each of said plurality of end cap units retain the first flat retaining element inside the hollow shipping container and the second retaining element outside the hollow shipping container, and;

attaching the handle to the hollow shipping container, wherein the handle is comprised of a strap having the first end and the second end, wherein the first end of the handle is retained by the opening in one of the second retaining element of one of the plurality of retaining tabs and wherein the second end of the handle is retained by the opening in the second retaining element of one of the plurality of retaining tabs, and;

providing a hollow tubular shipping container.

3. The method of claim 2 further comprising removing the plurality of end cap units;

detaching the plurality of retaining tabs from each end of the hollow shipping container; and reconnecting the plurality of end cap units to form the hollow shipping container without the attachable handle.

* * * * *